United States Patent [19]

Gehlbach

[11] Patent Number: 4,627,612

[45] Date of Patent: Dec. 9, 1986

[54] OVERHEAD CLIMBER

[76] Inventor: Roger D. Gehlbach, 4321 John St., Vancouver, British Columbia, Canada, V5V 3W8

[21] Appl. No.: 704,481

[22] Filed: Feb. 22, 1985

[51] Int. Cl.[4] ..... A63B 9/00

[52] U.S. Cl. ..... 272/113; 272/112

[58] Field of Search ..... 272/113, 112, 85, 54; D21/242-246

[56] References Cited

U.S. PATENT DOCUMENTS

| | | | |
|---|---|---|---|
| D. 180,402 | 6/1957 | Harris | D21/245 X |
| 3,735,979 | 5/1973 | Levenberg | 272/113 X |
| 3,985,354 | 10/1976 | Schulkin | 272/134 |
| 4,278,250 | 7/1981 | Baynes et al. | 272/113 |

OTHER PUBLICATIONS

Popular Mechanics, Jun. 1983, p. 98.

*Primary Examiner*—Richard J. Apley
*Assistant Examiner*—John L. Welsh
*Attorney, Agent, or Firm*—Fulwider, Patton, Rieber, Lee & Utecht

[57] ABSTRACT

A play device having a pair of longitudinal members. Cross members join the longitudinal members to form a ladder-like structure. A first member is attached to one longitudinal member by different length limbs and includes a support section joining the limbs. A second member is attached to the other longitudinal member by different length limbs and also includes a support section joining the limbs. The first support member has its longer limb at that end of the play device where the second member has its shorter limb. There are locating means for the play device.

7 Claims, 6 Drawing Figures

OVERHEAD CLIMBER

FIELD OF THE INVENTION

This invention relates to a play device for children.

DESCRIPTION OF THE PRIOR ART

Present playground devices include conventional ladders extended horizontally from two adjacent wooden structures. While these devices offer excellent exercise for the fingers, arms, shoulders and chest muscles of a child they require a high minimal strength to be used. Thus many children cannot use the apparatus at all, especially very young, physically underdeveloped and handicapped children. Of course such children are those most in need of exercise or, at least, are likely to benefit most from the exercise

SUMMARY OF THE INVENTION

The present invention seeks to overcome this disadvantage by providing a play device that is more accessible to young and physically underdeveloped children but also remains both entertaining and challenging for older, more mature children. More specifically the present invention provides a play device comprising a pair of longitudinal members; a plurality of cross members joining the longitudinal members; a first member attached to one longitudinal member by different length limbs and including a support section joining the limbs; a second member attached to the other longitudinal member by different length limbs and including a support section joining the limbs; the first support member having its longer limb at that end of the play device where the second member has its shorter limb; and locating means for the play device.

DRAWINGS

The invention is illustrated, merely by way of example, in the accompanying drawings in which.

DESCRIPTION OF THE PREFERRED EMBODIMENTS

Figure 1:
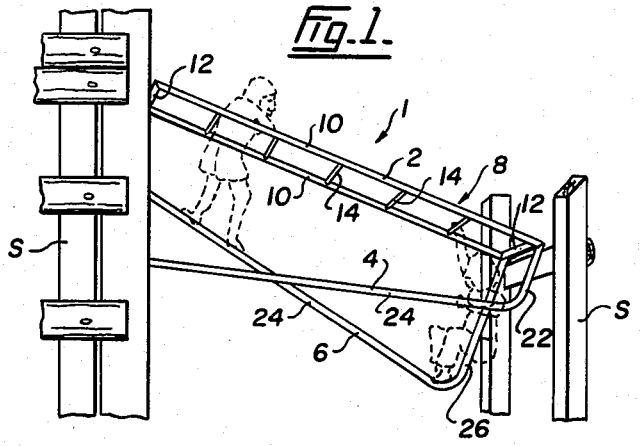
FIG. 1 is a side view of a play device according to the present invention installed.

FIGS. 1 to 4 show a play device 1 comprising a ladder 2 and two substantially U-shaped bars 4 and 6. The ladder 2 is composed of a tubular frame 8 having sides 10 and ends 12 with a plurality of evenly spaced parallel rungs 14 joining the sides. The frame is rectangular in shape. At the ends 12 of the ladder 2 are a pair of tabs 18 which act as mounting points for the ladder. In the embodiment of FIGS. 1 to 4 apertures 20 are formed in the tabs to allow bolts, screws or other such fasteners to pass through into an adjoining wooden support structure generally indicated at S in FIG. 1. The play structure 1 is thus rigidly secured in the desired position. Tabs 18 may be connected to frame ends 12 at a variety of angles relative to sides 10, not just horizontal as depicted, to ensure a proper mounting.

There is a generally U-shaped support bar 4 secured to the underside of side 10 of the ladder. The bar 4, preferably welded in position, comprises a short vertical section 22, a downwardly sloping portion 24 and a long vertical section 26. Bar 6, attached to the opposite side of the ladder, is of similar construction but mounted in such a way that it is reversed with respect to the bar 4. That is immediately opposite short vertical section 22 of one bar on one side there is long vertical section 26 of the other bar on the other side. Immediately opposite long vertical section 26 of one bar on one side is the short vertical section 22 of the other side. Downwardly sloping portion 24 slopes downwardly to the right on one side and downwardly to the left on the other side.

Thus when the ladder is suspended between two support structures S of different heights one bar may assume a horizontal position while the second bar assumes a steeply sloping position. Of course it is also possible to mount the device with the ladder generally horizontal. Support structure S may be of wooden beams but a metal structure is equally appropriate.

Figure 2:
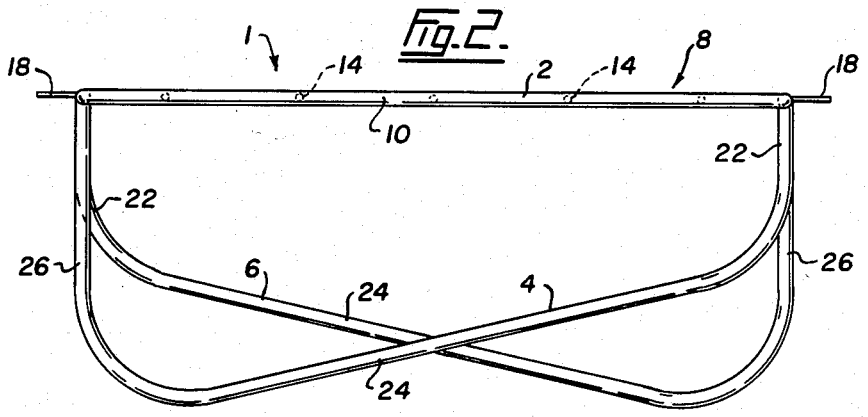
FIG. 2 is a side view of the play device.
Figure 3:
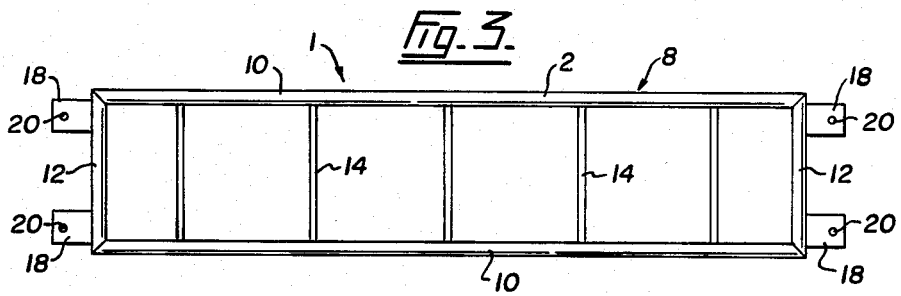
FIG. 3 is a plan view of FIG. 2.
Figure 4:
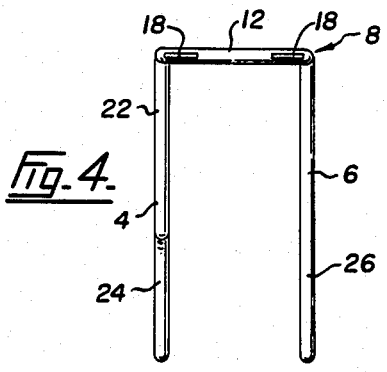
FIG. 4 is an end view of the embodiment of FIGS. 2 and 3.
Figure 5:
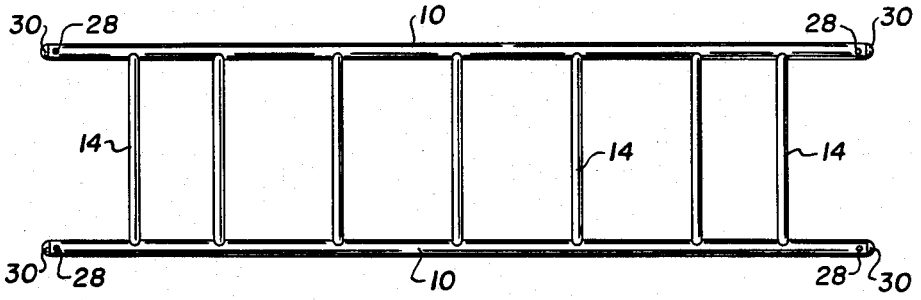
FIGS. 5 and 6 are plan views of further embodiments.
Figure 6:
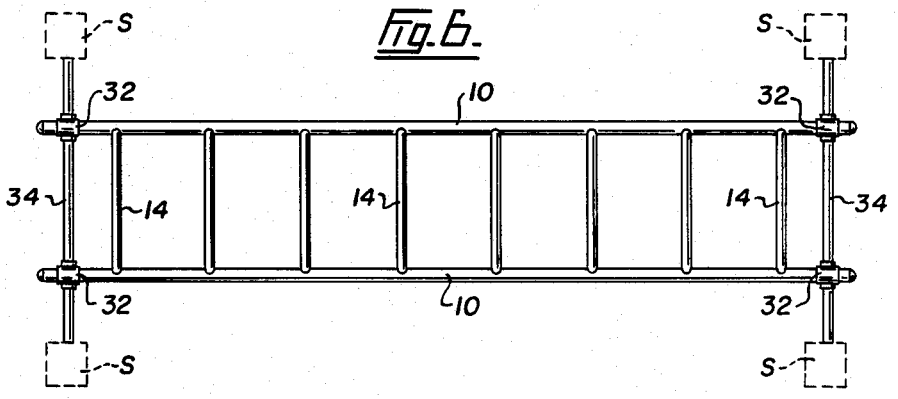

FIGS. 5 and 6 illustrate further methods of locating the device 1 on a support structure, replacing the tabs 18 of FIGS. 2 to 4. In FIG. 5 the end numbers 12 are not present. Sides 10 extend beyond rungs 14 and are provided with holes 28 to receive bolts, screws or the like to locate the device on a support structure. Protective Caps 30 are also down at the end of each slide 10.

In FIG. 6 the sides 10 are engaged by cross fittings 32 which also engage cross bars 34 at right angles to sides 10 and mounted in support structure S. Cross fittings 32 are well known and are available, for example, under the trade mark Hollaender.

The substantially U-shaped bars 4 and 6 enable children with relatively underdeveloped hand and shoulder muscles to obtain good play and recreation from the structure, including children who would normally just dangle briefly and then have to drop to the ground from a conventional, horizontal ladder. This is because the bars 4 and 6 may be used as a foot rest or platform. Older, more muscular children, may use the ladder in a more conventional way, that is swinging from one or more rungs 14 and using the bars 4 and 6 only when tired.

The bars 4 and 6 can also be considered a safety feature, reducing the possibility of a loss of grip on the ladder and resultant fall.

The bars 4 and 6 also perform other useful functions when the structure is used to connect play structures of different height. One bar 4 or 6 may assume a horizontal position, and be used to access the rungs of the ladder. The other bar assumes a downwardly inclined position and can be used as a bannister type pole for sliding down.

The structure is desirably of coated metal pipe. Coating may for example be by hot dip galvanizing or by powder coating with polyurethane after construction to prevent corrosion. The polyurethane may, of course, be coloured.

I claim:

1. A play device comprising:

a pair of longitudinal members, each member having a first end and a second end;

a plurality of cross members joining the longitudinal members;

a first member attached to one longitudinal member at each end of the longitudinal member by different length limbs and including a straight support section joining the limbs, the support section extending in a gradual, uniform slope, relative to the longitudinal member;

a second member attached to the other longitudinal member at each end of the longitudinal member by different length limbs and including a straight support section joining the limbs, the support section extending in a gradual, uniform slope, relative to the longitudinal member;

the first support member having its longer limb at that end of the play device where the second member has its shorter limb; and locating means for the play device.

2. A device as claimed in claim 1 in which the locating means comprises a plurality of tabs at each end of the structure.

3. A device as claimed in claim 2 in which the tabs have openings formed in them to accept fasteners.

4. A device as claimed in claim 1 including support means to support the play device raised above the ground.

5. A device as claimed in claim 4 in which the support means comprises a structure of wooden beams.

6. A play device as claimed in claim 1 in which the locating means comprises openings in the longitudinal members to receive fasteners.

7. A play device as claimed in claim 1 in which the locating means comprise cross fittings attaching the longitudinal members to cross bars.

* * * * *